US007098902B2

(12) United States Patent
Tamura

(10) Patent No.: US 7,098,902 B2
(45) Date of Patent: Aug. 29, 2006

(54) DISPLAY DRIVER, ELECTRO-OPTICAL DEVICE, AND METHOD OF SETTING DISPLAY DRIVER PARAMETERS

(75) Inventor: Tsuyoshi Tamura, Hara-mura (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

(21) Appl. No.: 10/376,596

(22) Filed: Mar. 3, 2003

(65) Prior Publication Data

US 2003/0189539 A1 Oct. 9, 2003

(30) Foreign Application Priority Data

Mar. 7, 2002 (JP) ..... 2002-061467

(51) Int. Cl.
*G09G 5/00* (2006.01)

(52) U.S. Cl. ..... 345/204; 345/98

(58) Field of Classification Search ..... 345/87, 345/204, 694, 441, 98–100, 590, 211–213
See application file for complete search history.

(56) References Cited

U.S. PATENT DOCUMENTS

| | | | | |
|---|---|---|---|---|
| 5,532,718 | A | 7/1996 | Ishimaru | |
| 5,627,457 | A | 5/1997 | Ishiyama et al. | |
| 6,008,791 | A * | 12/1999 | Arai et al. | 345/428 |
| 6,181,313 | B1 * | 1/2001 | Yokota et al. | 345/100 |
| 6,252,606 | B1 * | 6/2001 | Vaswani et al. | 345/441 |
| 6,271,825 | B1 * | 8/2001 | Greene et al. | 345/694 |
| 6,275,209 | B1 | 8/2001 | Yamamoto | |
| 6,414,664 | B1 * | 7/2002 | Conover et al. | 345/89 |
| 6,593,934 | B1 * | 7/2003 | Liaw et al. | 345/590 |

FOREIGN PATENT DOCUMENTS

| | | |
|---|---|---|
| EP | 1 014 333 A1 | 6/2000 |
| JP | 61-256382 | 11/1986 |
| JP | 04-116621 | 4/1992 |
| JP | 04-194818 | 7/1992 |
| JP | A 9-160001 | 6/1997 |
| JP | A 2001-092436 | 4/2001 |
| JP | A 2003-531407 | 10/2003 |
| WO | WO 01/80211 A1 | 10/2001 |

* cited by examiner

*Primary Examiner*—Richard Hjerpe
*Assistant Examiner*—Kimnhung Nguyen
(74) *Attorney, Agent, or Firm*—Oliff & Berridge, PLC

(57) ABSTRACT

A display driver includes a correction parameter register which stores correction parameters for correcting contrast adjustment values; a computation circuit which adds a correction value specified by a correction parameter to a contrast adjustment value instructed by an MPU, to calculate a corrected contrast adjustment value; and a drive circuit which drives a display panel with a drive voltage that is obtained based on the corrected contrast adjustment value. The display driver uses a correction value for a contrast reference value that is obtained by measuring a display characteristic of the display panel. At power-on, at a system reset, or at refresh timing, a correction parameter that has been read from the EEPROM is written to the correction parameter register, to initialize or refresh the register.

15 Claims, 13 Drawing Sheets

ELECTRO-OPTICAL DEVICE

FIG. 8A

| REFRESH PERIOD INFORMATION |
| --- |
| NO REFRESH |
| 64 FRAMES |
| 128 FRAMES |
| 192 FRAMES |
| 256 FRAMES |

FIG. 8B

| MANUFACTURE INFORMATION |
| --- |
| PRODUCTION ID |
| PRODUCT VERSION |
| PRODUCT NUMBER |

DISPLAY DRIVER, ELECTRO-OPTICAL DEVICE, AND METHOD OF SETTING DISPLAY DRIVER PARAMETERS

Japanese Patent Application No. 2002-61467, filed on Mar. 7, 2002, is hereby incorporated by reference in its entirety.

BACKGROUND

The present invention relates to a display driver, an electro-optical device, and a method of setting display driver parameters.

With a liquid-crystal device (broadly speaking: an electro-optical device) used in an electronic instrument such as a mobile phone, it is preferable to execute display operations with the optimal display characteristics (contrast).

However, since there are some variations in display characteristics between the display panels of liquid-crystal devices, an important technical problem concerns how to suppress the effects of such variations.

It is also preferable that the display characteristics of a liquid-crystal device are maintained at optimal levels, even if an external factor such as electrostatic discharge (ESD) occurs.

In an electronic instrument in which a liquid-crystal device is incorporated, the firmware of the electronic instrument controls the display of the liquid-crystal device. In such a case, it is preferable to simplify the work of writing firmware as far as possible, in order to shorten the development period of the electronic instrument.

SUMMARY

An aspect of the present invention relates to a display driver for driving a display panel, the display driver including:

a correction parameter register which stores a correction parameter for correcting a contrast adjustment value that is instructed by a processing section;

a computation circuit which adds a correction value specified by the correction parameter to the contrast adjustment value instructed by the processing section, and calculates a corrected contrast adjustment value; and a drive circuit which drives a display panel at a drive voltage that is obtained based on the computed corrected contrast adjustment value.

BRIEF DESCRIPTION OF THE SEVERAL VIEWS OF THE DRAWING

FIGS. 8A and 8B are illustrative of refresh period information and manufacture information;

DETAILED DESCRIPTION OF THE EMBODIMENT

Figure 1:
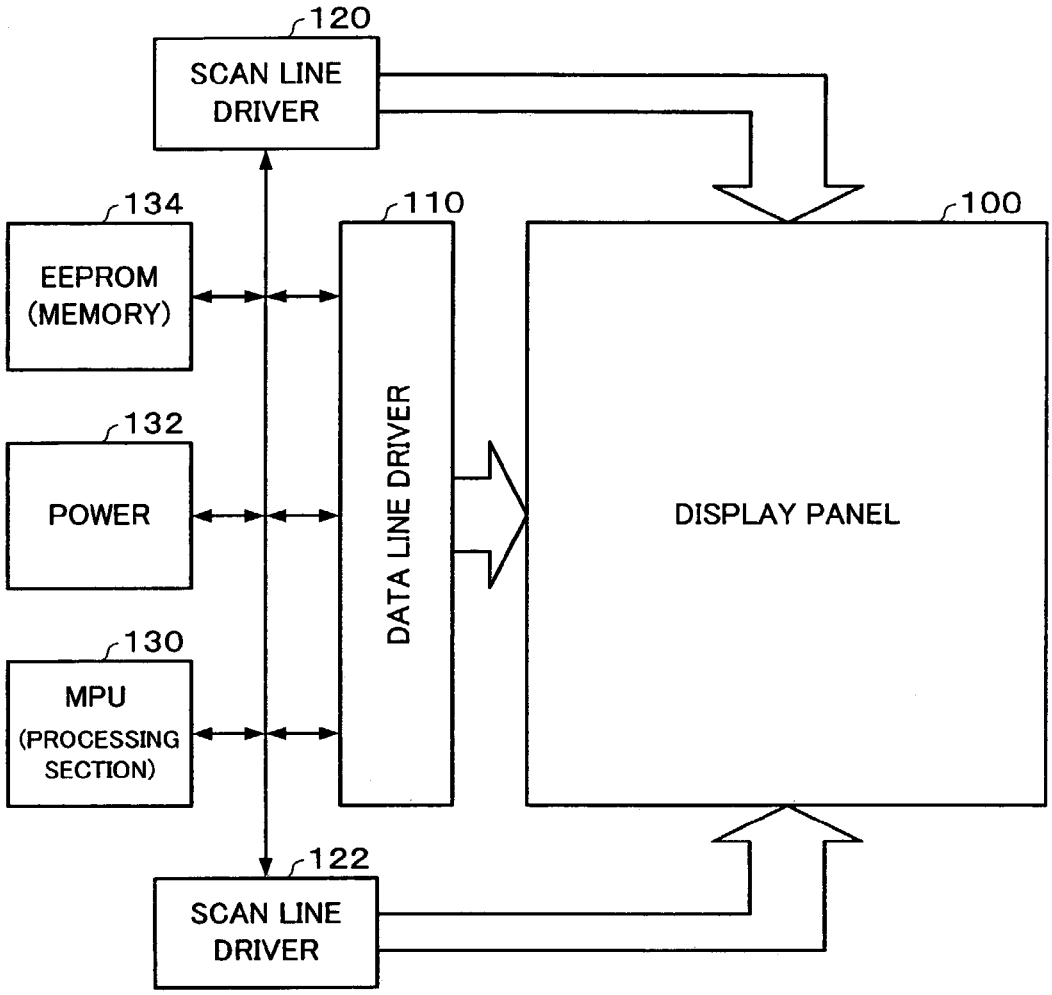
FIG. 1 is a block diagram of an example of the configuration of an electro-optical device.

Embodiments of the present invention are described in detail below. Note that the embodiments described below do not in any way limit the scope of the present invention as laid out in the claims herein. In addition, the entirety of the configuration described below should not be taken as essential structural components of the present invention.

The embodiments were devised in the light of the above-described technical problem, making it possible to provide a display driver, an electro-optical device, and a method of setting display driver parameters that enable the implementation of appropriate display characteristics.

An embodiment of the present invention relates to a display driver for driving a display panel, the display driver including:

a correction parameter register which stores a correction parameter for correcting a contrast adjustment value that is instructed by a processing section;

a computation circuit which adds a correction value specified by the correction parameter to the contrast adjustment value instructed by the processing section, and calculates a corrected contrast adjustment value; and a drive circuit which drives a display panel at a drive voltage that is obtained based on the computed corrected contrast adjustment value.

This embodiment facilitates the addition of a correction value specified by a correction parameter to a contrast adjustment value that is instructed by the processing section. The display panel is driven and the contrast of the display panel is adjusted by a drive voltage obtained on the basis of the thus-obtained corrected contrast adjustment value.

This embodiment therefore makes it possible to set a contrast adjustment value in the display driver, without having to consider variations in the display characteristics. This enables a simplification of the processing of the processing section.

With this embodiment, the correction value specified by the correction parameter may be a correction value for a contrast reference value that is obtained by measuring a display characteristic of the display panel.

Note that the correction parameter register could be used to store correction values or measured contrast reference value.

This embodiment may further include:

a memory control circuit which performs access control over a memory which is provided outside or inside the display driver and stores at least the correction parameter; and a register write circuit which writes the correction parameter that has been read from the memory to the correction parameter register at a given refresh timing and performs refresh processing of the correction parameter register.

With this embodiment, a correction parameter that has been read from a memory is written to the correction parameter register (control register) at the given refresh timing, to refresh the correction parameter register. This therefore enables the execution of display control of the display panel by using appropriate correction parameters, making it possible to stabilize and maintain appropriate display characteristics.

With this embodiment, the register write circuit may write the correction parameter to the correction parameter register and may perform refresh processing of the correction parameter register, in a non-display period of the display panel.

In such a case, the non-display period is a period during which a write processing to the correction parameter register will have no adverse effect on the display operation of the display panel. It should be noted, however, that the refresh processing could be done in a period other than the non-display period.

With this embodiment, the register write circuit may write the correction parameter to the correction parameter register periodically and may perform refresh processing of the correction parameter register, after power-on or after a system reset.

Note that it is further desirable that the refresh processing is done during a periodically occurring non-display period.

This embodiment may further include:

a memory control circuit which performs access control over a memory which is provided outside or inside the display driver and stores at least the correction parameter; and a register write circuit which writes the correction parameter that has been read from the memory to the correction parameter register and performs initialization processing of the correction parameter register, at power-on or at a system reset.

This embodiment enables writing of a correction parameter that has been read from a memory to the correction parameter register at power-on or at a system reset, to initialize the correction parameter register. This embodiment therefore makes it possible to read the appropriate correction parameter automatically, to enable control over the display of the display panel.

With this embodiment, the register write circuit may inhibit access by the processing section to the correction parameter register while writing the correction parameter to the correction parameter register.

This makes it possible to prevent a situation in which access from the processing section clashes with access from a memory.

Another embodiment of the present invention relates to an electro-optical device including: any of the above described display drivers; the display panel that is driven by the display driver; and the processing section which controls an operation of the display driver.

A further embodiment of the present invention relates to a method of setting a parameter of any of the above described display drivers, the method including: measuring a display characteristic of the display panel being driven by the display driver; and writing the correction parameter specified by measurement to the memory.

Embodiments of the present invention are described below with reference to the accompanying drawings.

1. Electro-Optical Device

An example of the configuration of an electro-optical device in accordance with an embodiment of the present invention is shown in FIG. 1.

This electro-optical device (broadly speaking: a liquid-crystal device) includes a display panel 100 (broadly speaking: a liquid crystal panel).

This display panel 100 has a plurality of data lines (signal lines), a plurality of scan lines, and a plurality of pixels defined by the data lines and scan lines. A display action is implemented by causing changes in the optical characteristics of an electro-optical element (broadly speaking: a liquid crystal element) in each pixel region.

Note that the display panel 100 could be a panel employing a simple-matrix method, or it could be a panel employing an active-matrix method using switching elements (two-terminal non-linear elements) such as thin-film transistors (TFTs) or thin-film diodes (TFDs).

This electro-optical device further includes a data line driver 110 (a data line drive circuit, an X driver, and a source driver) and scan line drivers 120 and 122 (each with a scan line drive circuit, a Y driver, and a gate driver).

In this case, the data line driver 110 drives data lines of the display panel 100, based on image data. The scan line drivers 120 and 122, on the other hand, drive sequential scans of the scan lines of the display panel 100.

Note that the scan line drivers 120 and 122 could be incorporated within the data line driver 110.

The electro-optical device also includes an MPU 130 (broadly speaking: a processing section).

In this case, this microprocessing unit (MPU) 130 controls the data line driver 110, the scan line drivers 120 and 122, a power circuit 132, and an EEPROM 134.

More specifically, the MPU 130 supplies an operating mode setting, a vertical synchronization signal, and a horizontal synchronization signal to the data line driver 110 and the scan line drivers 120 and 122. It also passes instructions concerning power source settings to the power circuit 132. Furthermore, it passes memory access instructions to the EEPROM 134 through the data line driver 110, by way of example.

Note that the MPU 130 (processing section) could be implemented by a general-purpose processor (CPU) or by a controller circuit that is an ASIC.

The functions of the MPU 130 could be implemented by an external MPU (processing section) of an electronic instrument (such as a mobile phone, pager, timepiece, liquid crystal TV, car navigation device, calculator, wordprocessor, projector, or POS terminal).

The power circuit 132 generates the various power voltages (grayscale voltages) necessary for driving the display panel 100, based on a reference voltage supplied from the outside. The thus-generated power voltages are supplied to the data line driver 110 and the scan line drivers 120 and 122.

The EEPROM 134 (broadly speaking: memory, non-volatile memory, or ROM) stores various items of information used for operating the electro-optical device.

More specifically, the EEPROM 134 of this embodiment stores display characteristic control parameters (such as a contrast adjustment parameter, display control parameters, or grayscale control parameters). The thus-stored display characteristic control parameters are read out at power-on, at system reset, and at the refresh timing. The thus-read display characteristic control parameters are accommodated in a control register of the data line driver 110.

Note that the EEPROM 134 could be provided outside of the data line driver 110 or it could be provided internally. The configuration could also be such that the MPU 130 accesses the EEPROM 134 directly, not through the data line driver 110.

Some or all of the data line driver 110, the scan line drivers 120 and 122, the MPU 130, the power circuit 132, and the EEPROM 134 could be formed on the display panel 100 (glass substrate)

2. Data Line Driver

Figure 2:
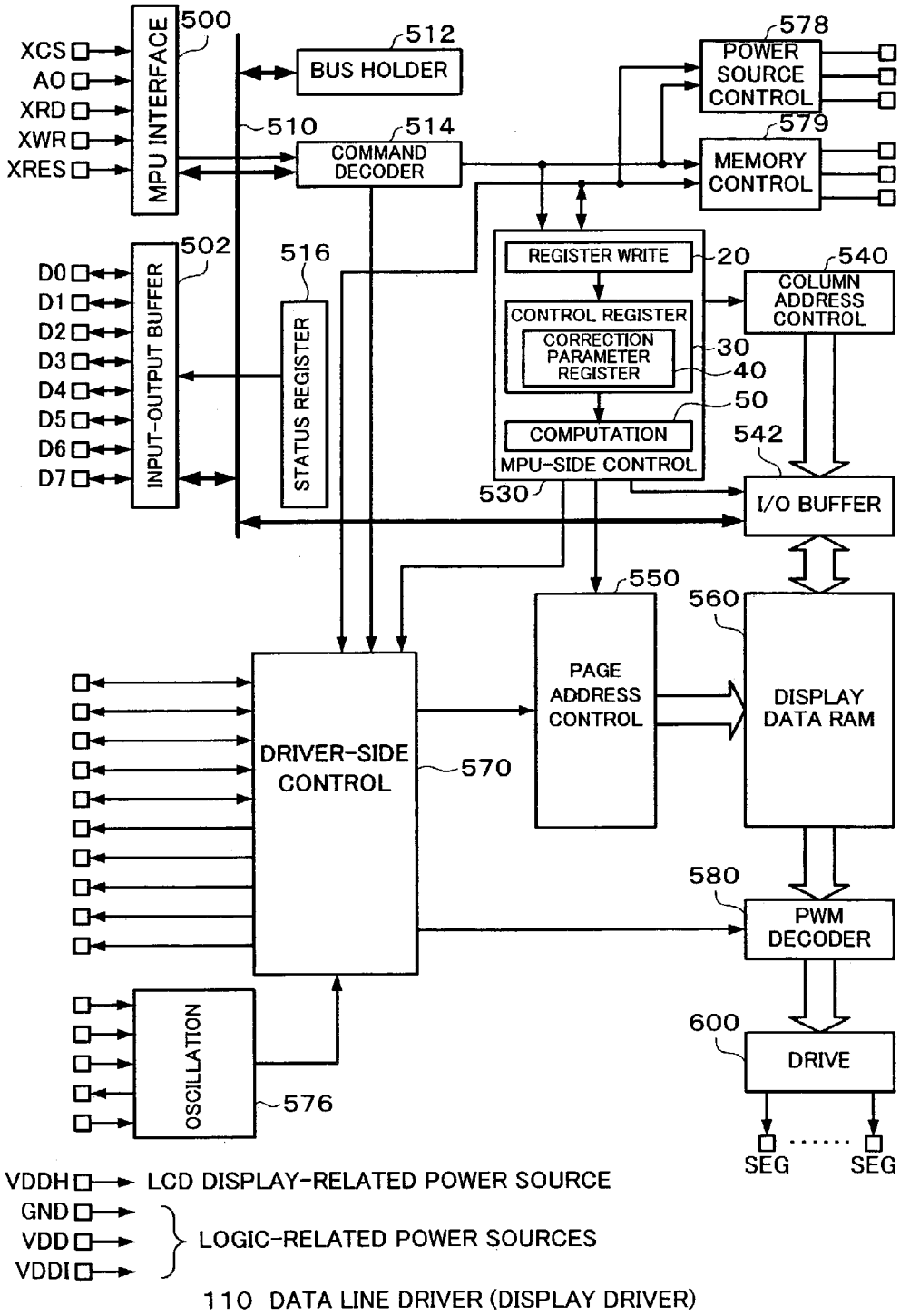
FIG. 2 is a block diagram of an example of the configuration of a data line driver (display driver)

An example of the configuration of the data line driver 110 (broadly speaking: display driver or display drive circuit) of this embodiment is shown in FIG. 2. Note that the data line driver 110 of this embodiment does not necessarily include all of the blocks shown in FIG. 2 and thus some of them could be omitted.

Signals such as an inverted chip select signal XCS, a command/data identification signal A0, an inverted read signal XRD, an inverted write signal XWR, and an inverted reset signal XRES are input to an MPU interface 500.

Data such as 8-bit data (command) D7 to D0 is input to an input-output buffer 502.

A bus holder 512 is designed to hold data on an internal bus 510 temporarily.

A command decoder 514 decodes (deciphers) commands that have been input from the MPU 130 through the MPU interface 500, and transfers the decoded results to an MPU-side control circuit 530.

A status register 516 holds status information of the data line driver 110 (such as whether or not the display is on, whether or not it is in partial display mode, or whether or not it is in sleep mode).

The MPU-side control circuit 530 controls read and write operations with respect to a display data RAM 560, based on commands of the MPU 130 that are input through the command decoder 514. These read/write operations are implemented by a column address control circuit 540 and a page address control circuit 550 that are controlled by the MPU-side control circuit 530.

The column address control circuit 540 specifies write column addresses and read column addresses of display data.

The page address control circuit 550 specifies write page addresses and read page addresses of display data. The page address control circuit 550 also specifies display addresses for each line, controlled by the driver-side control circuit 570.

The driver-side control circuit 570 (panel-side control circuit) generates signals such as a grayscale control pulse GCP (a clock pulse signal for pulse width measuring), a polarity inversion signal FR, and a latch pulse LP, based on oscillation output from an oscillation circuit 576, to control the page address control circuit 550 and a PWM decoder circuit 580.

The PWM decoder circuit 580 performs pulse-width modulation (PWM) decoding, based on display data that has been read from the display data RAM 560.

A drive circuit 600 causes a shift in signals from the PWM decoder circuit 580 corresponding to the voltage of the display panel system, for supply to the data lines of the display panel 100.

With the embodiment configured as described above, it is possible to display various images on the display panel 100.

3. Initialization and Refresh of Display Characteristic Control Parameters

With a liquid-crystal device (electro-optical device) used in an electronic instrument such as a mobile phone, it is preferable to adjust the display characteristics of the display panel (such as the contrast and hue thereof) during inspection or at shipping. It is also preferable that shipping to the manufacturer of the electronic instrument and incorporation into the electronic instrument is done after the optimal adjustment has been applied.

In such a case, the manufacturer of the electronic instrument has no interest in the details of the display characteristics of the display panel, provided that those display characteristics are optimized. If is it assumed that the setting of these display characteristics will be done by firmware, it becomes necessary to change the descriptive portion for display characteristic setting in the firmware. This makes it highly likely that the manufacturer of the electronic instrument would be forced to perform complicated work.

With an electronic instrument such as a mobile phone, various external factors such as electrostatic discharge (ESD) can be caused by the usage state thereof. If the previously set display characteristics are changed by such an external factor, it could happen that it is no longer possible to maintain the optimal display characteristics.

This embodiment is designed to solve the various problems described above, by using the configuration described below.

The data line driver 110 of this embodiment is provided with a memory control circuit 579, as shown in FIG. 2.

This memory control circuit 579 performs access control (read/write control) with respect to the EEPROM 134 of FIG. 1.

More specifically, parameters for controlling (setting) the display characteristics (such as contrast and hue) of the display panel 100 are stored in the EEPROM 134. These display characteristic control parameters can be obtained by measuring the display characteristics of the display panel 100 at shipping or during inspection of the liquid-crystal device (electronic instrument), by way of example, and the optimal display characteristic control parameters corresponding to the results of this measurement are written to the EEPROM 134. Use of these display characteristic control parameters allows for any variation in the display characteristics of the display panel 100, making it possible to avoid a situation in which there are different display characteristics for each display panel or each type of display panel. The memory control circuit 579 of this embodiment reads various items of information, including these display characteristic control parameters, from the EEPROM 134.

With the data line driver 110 of this embodiment, a register write circuit 20 (register refresh circuit and register initialization circuit), a control register 30, and a computation circuit 50 are included within the MPU-side control circuit 530.

In this case, the control register 30 is a register that is used for controlling the data line driver 110.

More specifically, if the MPU 130 of FIG. 1 issues a command, that command is decoded by the command decoder 514 of FIG. 2. A parameter that is set by that command is written to the control register 30 through the input-output buffer 502 and the register write circuit 20. This ensures that the operation of the MPU-side control circuit 530 is based on the control parameters (operating parameters and command parameters) that have been written to the control register 30. In other words, the MPU-side control circuit 530 controls other components such as the column address control circuit 540, an I/O buffer 542, the page address control circuit 550, and the driver-side control circuit 570, based on the contents of the control register 30.

The provision of this control register 30 makes it possible for the MPU 130 to cause the data line driver 110 to operate in accordance with commands that it has issued, thus controlling the display of the display panel 100.

Note that the control register 30 could be implemented by holding circuits such as D flip-flops, or it could be implemented by memory means such as RAM.

With this embodiment, the register write circuit 20 writes to this control register 30.

More specifically, the register write circuit 20 writes display characteristic control parameters (operating parameters and command parameters) that have been read out from the EEPROM 134 (memory, non-volatile memory, or ROM) to the control register 30 at power-on or at a system reset (at initialization), to initialize the control register 30.

The execution of such initialization processing ensures that the display characteristic control parameters stored in the EEPROM 134 are written automatically to the control register 30 at power-on or at a system reset (at a software reset).

The MPU-side control circuit 530 can therefore execute optimal display control for the display panel 100, using the display characteristic control parameters that have been written to the control register 30.

It is no longer necessary for the firmware (program) that operates in the MPU 130 (processing section) to write the display characteristic control parameters to the control register 30 at power-on or at a system reset. This makes it possible to remove the need to define the display characteristic control parameters in firmware, thus simplifying the operation of the firmware. The same firmware can be used for different types of display panel, thus enabling a reduction in the development load on electronic instrument manufacturers.

With this embodiment, the register write circuit 20 takes the display characteristic control parameters (operating parameters and command parameters) that have been read from the EEPROM 134 and writes them to the control register 30 at a given refresh timing, to refresh the control register 30.

This ensures that it is possible to always maintain the display characteristics of the display panel 100 at optimal levels.

In other words, the usage state of an electronic instrument such as a mobile phone could result in an external factor such as an electrostatic discharge, making it likely that the display characteristic control parameters in the control register 30 would be overwritten by an inappropriate value, or even lost altogether. If the display characteristic control parameters were to be overwritten or lost, it would no longer be possible to maintain the optimal display characteristics.

With this embodiment of the present invention, the optimal display characteristic control parameters stored in the EEPROM 134 are written again to the control register 30 by the register write circuit 20 performing the refresh operation, even in such a case. It is therefore possible to maintain optimal display characteristics for the display panel 100, even when an external factor such as electrostatic discharge occurs.

To simplify the contrast adjustment processing, this embodiment is provided with a correction parameter register 40 (VOLDEF) within the control register 30, and also the computation circuit 50.

In this case, the correction parameter register 40 is a register for storing a correction parameter (one of the display characteristic control parameters) for correcting the contrast adjustment (setting) value. This correction parameter can be obtained by measurement of a characteristic such as the contrast (brightness) of the display panel 100 of the liquid-crystal device (electronic instrument) at shipping or during inspection, by way of example, so that a correction parameter that is optimized in accordance with the measurement results is written to the EEPROM 134. Use of this correction parameter makes it possible to allow for variations in the contrast of the display panels 100, thus preventing a situation in which the display characteristics differ for each display panel or type of display panel.

With this embodiment, this correction parameter that has been stored in the EEPROM 134 is written to the correction parameter register 40 through the memory control circuit 579 and the register write circuit 20. More specifically, the correction parameter is written to the correction parameter register 40 at power-on or at a system reset, to perform initialization processing for the register 40. The correction parameter is then written to the register 40 at a given refresh timing, to refresh the register 40.

The computation circuit 50 of FIG. 2 adds a correction value specified by the correction parameter to the contrast adjustment value instructed by the MPU 130 (processing section), to compute a corrected contrast adjustment value.

In other words, this embodiment ensures that the contrast adjustment value is set by the issue of a command or the like from the MPU 130. When that happens, the computation circuit 50 adds the correction value specified by the correction parameter of the register 40 to the thus-set contrast adjustment value, to obtain the corrected contrast adjustment value. The thus-corrected contrast adjustment value is then output to the power circuit 132 of FIG. 1 through a power source control circuit 578, by way of example.

When that happens, the power circuit 132 generates a power voltage corresponding to the thus-corrected contrast adjustment value, and supplies it to the data line driver 110 (the drive circuit 600) and the scan line drivers 120 and 122. This ensures that the display panel 100 can perform the display operation at a contrast (brightness) corresponding to the corrected contrast adjustment value.

4. Refresh Timing

With this embodiment, refresh processing of the control register 30 is performed in a non-display period of the display panel 100 (display driver).

Figure 3A:
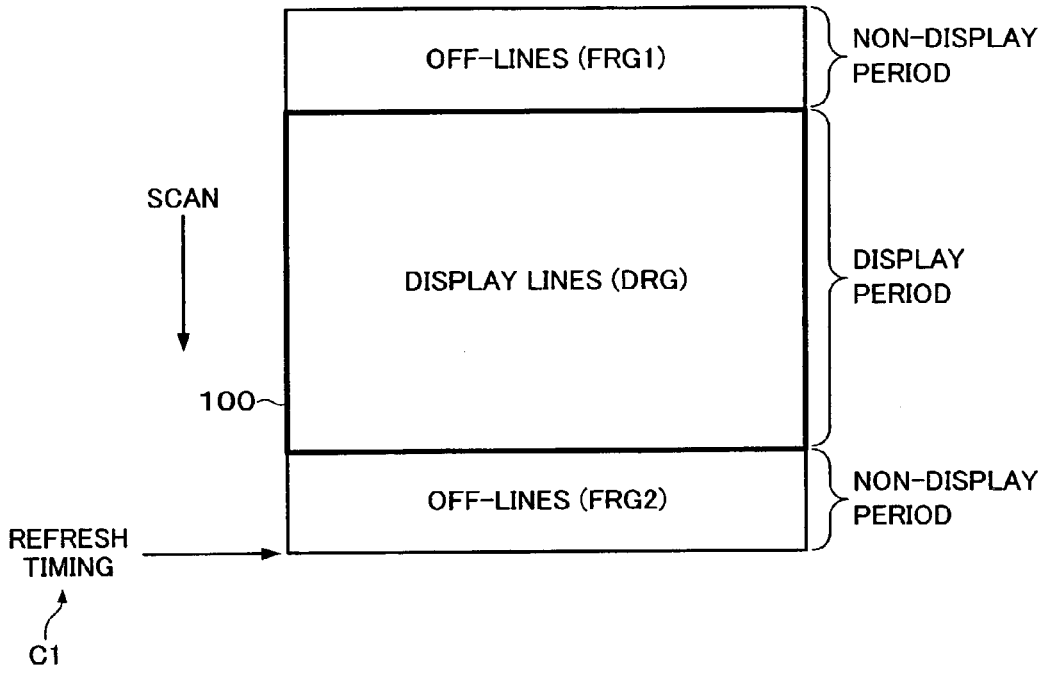
FIGS. 3A and 3B are illustrative of refresh timing.

More specifically, the display panel 100 of this embodiment is provided with a display line region DRG and off-line (display-off lines) regions FRG1 and FRG2, as shown in FIG. 3A.

In this case, the display line region DRG is the region in which the image is displayed in practice. The off-line regions FRG1 and FRG2, on the other hand, are regions in which no image is displayed (dummy regions).

Assume a case in which the upper off-line region FRG1 does not exist, by way of example. In such a case, the first scan line on the uppermost side of the display line region DRG will have the second scan line on the lower side thereof but there will be no scan line above it. The second scan line, on the other hand, will have the third scan line below it and also the first scan line above it. If the off-line region FRG1 were not present, therefore, the first scan line and the second scan line would have different parasitic capacitances, so there will be some unevenness in the display state of that portion.

In contrast thereto, if the off-line region FRG1 shown in FIG. 3A is provided, the first scan line will also have a dummy scan line above it. As a result, the characteristics of the first and second scan lines, such as their parasitic capacitances, can be made to be substantially the same, making it possible to prevent any unevenness in the display states thereof.

Similarly, the provision of the lower off-line region FRG2 ensures that the Nth scan line on the lowermost side of the display line region DRG has substantially the same characteristics, such as parasitic capacitance, as the (N-1)th scan line above it, making it possible to prevent any unevenness in the display states thereof.

Another reason for the provision of the off-line regions FRG1 and FRG2 is described below.

The number of display lines of the display panel 100 (the number of lines in the display line region) is generally different for different types of electronic instrument.

If a display panel 100 with a different number of lines is used for each type of electronic instrument in such a case, various problems would result, such as the product cost would increase and the development time would lengthen.

The provision of the off-line regions FRG1 and FRG2 shown in FIG. 3A makes it possible to change the number of scan lines in the off-line regions FRG1 and FRG2 in a variable manner, so that some of the scan lines of FRG1 and FRG2 can be allocated as scan (display) lines of the display line region DRG. In this manner, it is simple to accommodate a change in type of the electronic instrument, even if the number of display lines of the display panel 100 changes.

This embodiment also enables refreshing of the control register 30 during the non-display period of the display panel 100 (such as the scan periods of the off-line regions FRG1 and FRG2), as shown at C1 in FIG. 3A. Thus the refreshing of the control register 30 (writing of display characteristic control parameters) can be prevented from having any adverse effect on the display operation.

In other words, if the refreshing of the control register 30 were to be done during the display period of the display panel 100 (during the scan period of the display line region DRG), it is possible that that refresh processing would have an adverse effect on the display operation. It is possible that a stripe pattern could occur in the display line region DRG at the refresh timing. The method of this embodiment as shown in FIG. 3A can prevent such a situation from occurring.

Note that the refresh processing is shown at the scan timing of the final scan line of the off-line region FRG2 at C1 in FIG. 3A, but it could equally well be done at the scan timing of the first scan line of the off-line region FRG1. Alternatively, the refresh processing could be done at the scan timing of a scan line (line within FRG1 and FRG2) that differs from those scan lines.

Figure 3B:
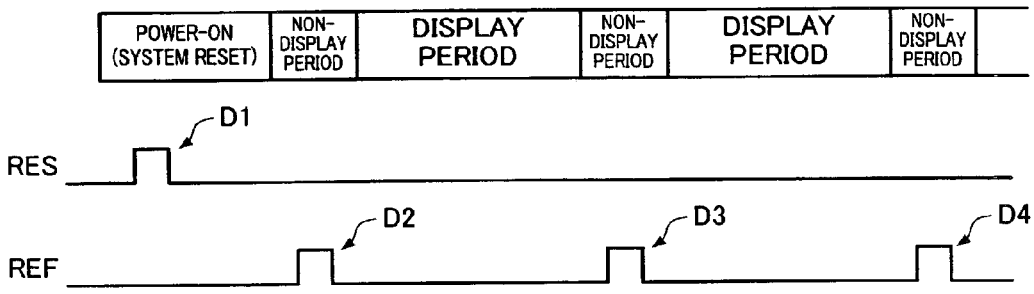

With this embodiment, a reset signal RES goes active at power-on (at system reset), as shown at D1 in FIG. 3B. This ensures that the display characteristic control parameters are written to the control register 30 and the control register 30 is initialized.

In addition, a refresh signal REF goes active periodically after power-on (after a system reset), as shown at D2, D3, and D4 in FIG. 3B. This ensures that the display characteristic control parameters are written to the control register 30 to refresh the control register 30 periodically.

This periodic refreshing makes it possible to stabilize and maintain the display characteristics of the display panel 100.

Note that the refresh processing could also be done periodically in periods other than the non-display period, provided it has no adverse effect on the display operation of the display panel 100.

5. Control Register

Figure 4:
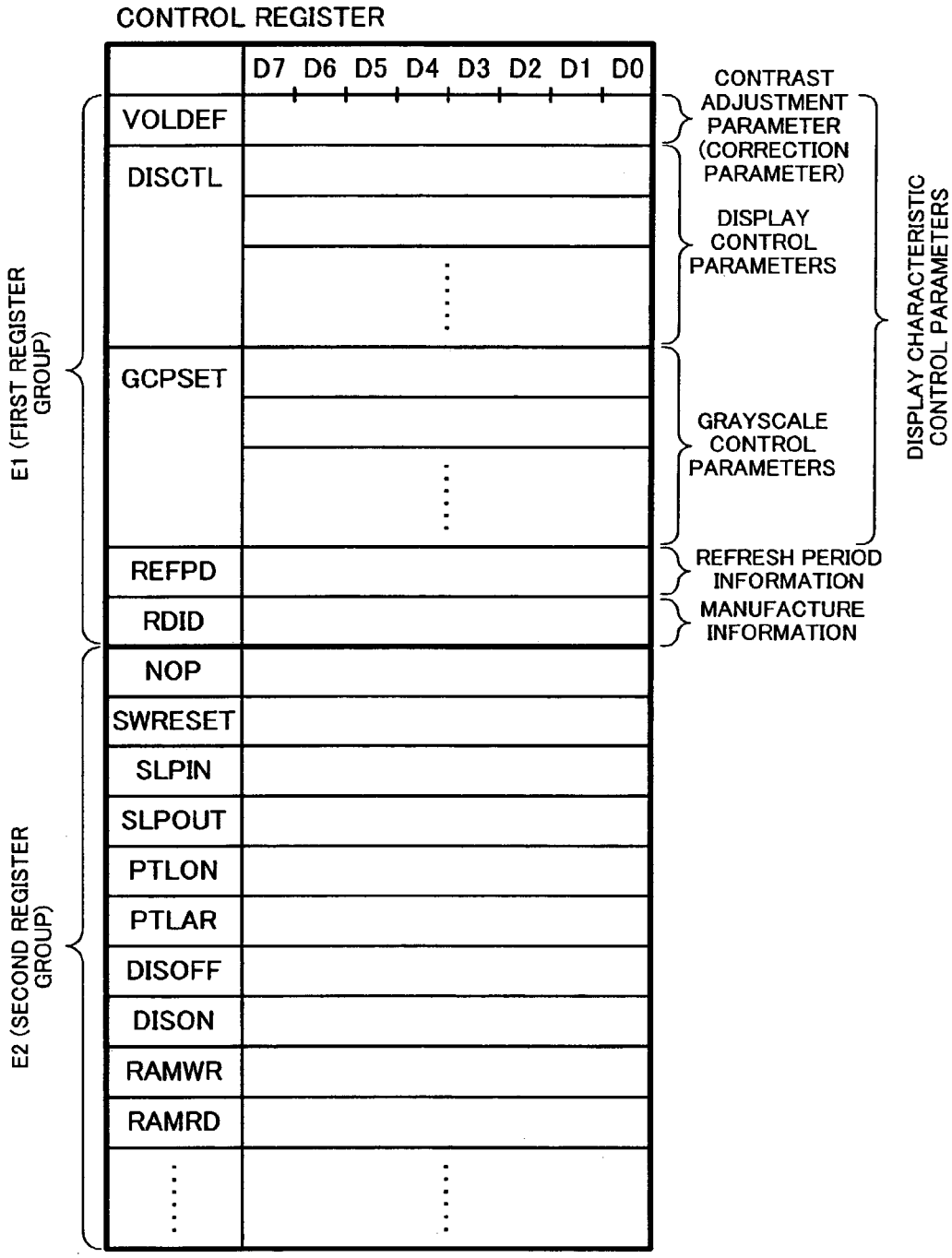
FIG. 4 is illustrative of the control register.

An example of the register map of the control register 30 is shown in FIG. 4.

In FIG. 4, a first register group (VOLDEF, DISCTL, GCPSET, REFPD, and RDID) denoted by E1 consists of registers relating to initialization processing or refresh processing. A second register group (NOP, SWRESET, SLPIN, SLPOUT, PTLON, PTLAR, DISOFF, DISON, RAMWR, and RAMRD) denoted by E2 consists of registers that are not related to initialization processing or refresh processing. Both of first and second register groups can be accessed (by write operations) by the MPU 130.

The registers VOLDEF, DISCTL, and GCPSET store display characteristic control parameters. Specifically, the register VOLDEF stores a contrast adjustment parameter (correction parameter), the register DISCTL stores display control parameters, and the register GCPSET stores grayscale control parameters.

The register REFPD stores refresh period information and the register RDID stores manufacture information.

One register in the second register group, NOP, is a register for instructing non-operation of the scan line driver (display driver) by the MPU 130 (register for storing parameters of a non-operation instruction command). The register SWRESET is used for instructing a software reset and the registers SLPIN and SLPOUT are used for instructing a sleep-in operation and a sleep-out operation. The registers PTLON and PTLAR are used for instructing partial display and partial area and the register DISOFF and DISON are used for instructing display-off and display-on. RAMWR and RAMRD are registers for instructing a write operation or read operation of the display data RAM 560 of FIG. 2.

In this case, the contrast adjustment parameter stored in the register VOLDEF is a contrast adjustment correction parameter that will be described later.

Various parameters could be considered as the display control parameters stored in the register DISCTL.

Figure 5:
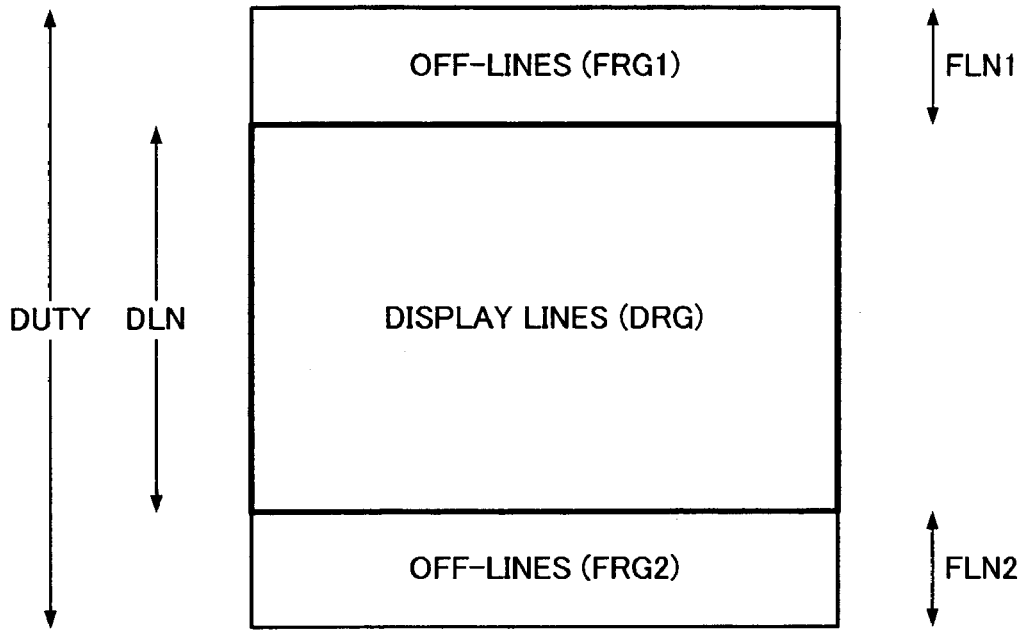
FIG. 5 is illustrative of display control parameters.

For example, as shown in FIG. 5, items such as the number of scan lines DLN of the display line region DRG, the numbers of scan lines FLN1 and FLN2 of the off-line regions FRG1 and FRG2, or the or duty count (total number of lines) DUTY could be included within the display control parameters (DISCTL).

The display control parameters (DISCTL) could also include a parameter that determines the drive method of the display panel 100.

Figure 6A:
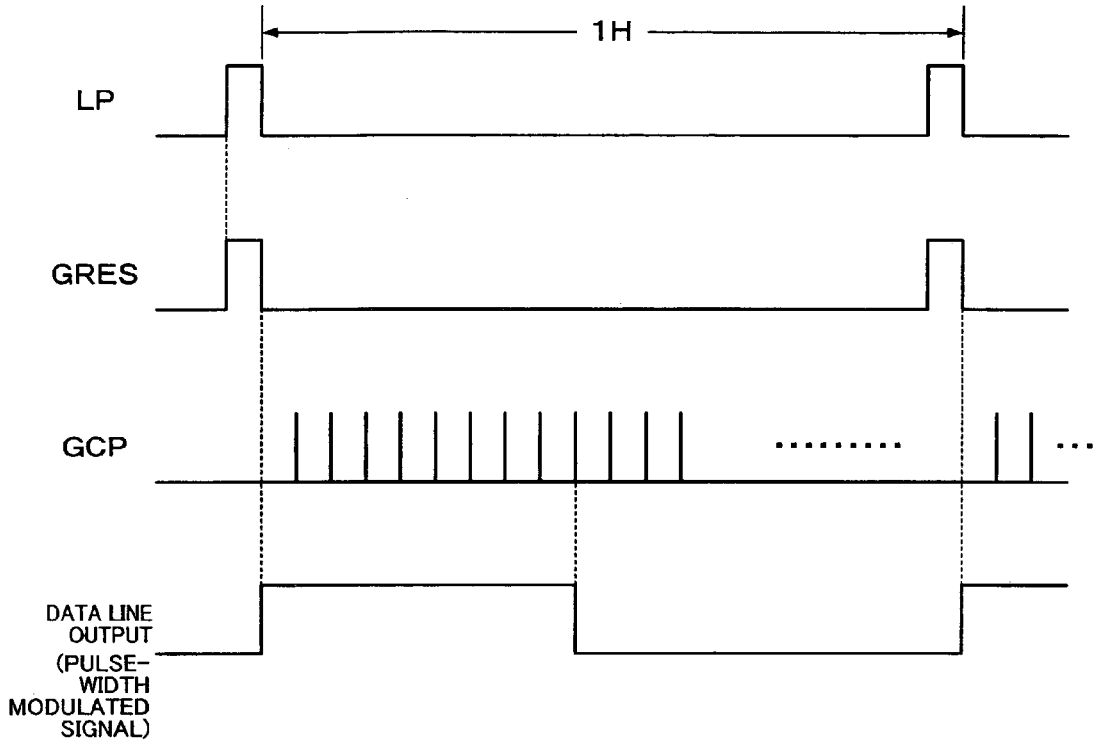
FIGS. 6A and 6B are further illustrative of display control parameters.
Figure 6B:
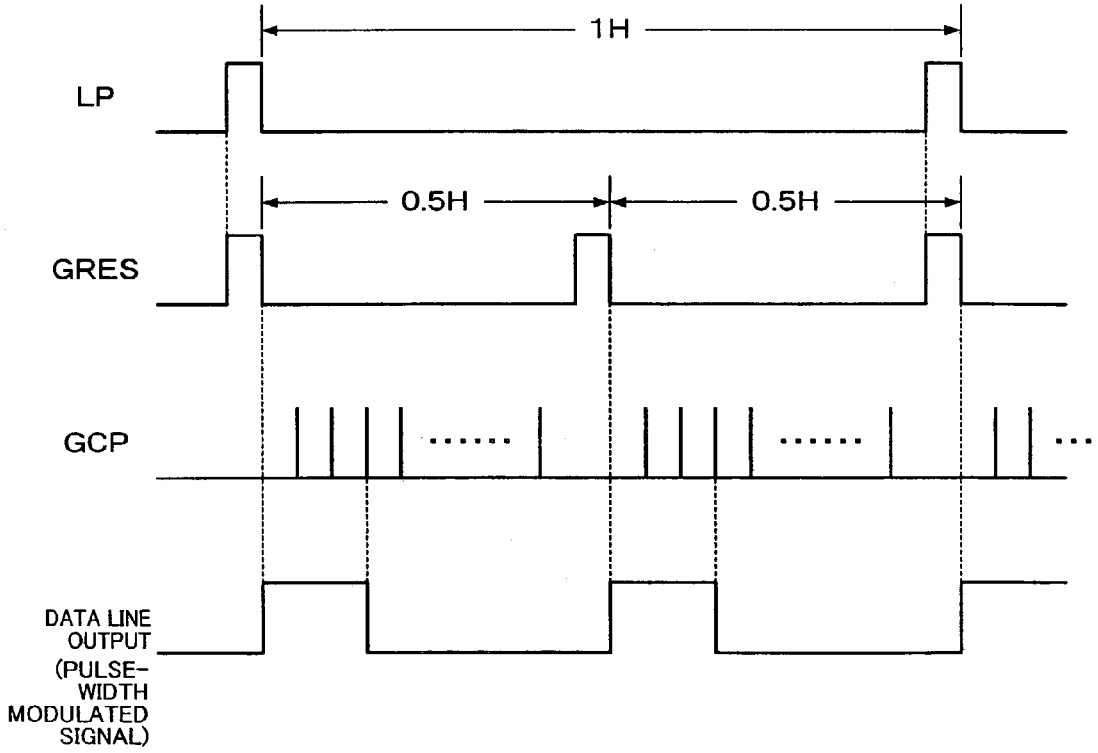

For example, either a 1H (one horizontal scan period) drive method as shown in FIG. 6A or a 0.5H drive method as. shown in FIG. 6B could be specified by a display control parameter.

The 1H period could be regulated by the falling edge of the latch pulse signal LP in FIGS. 6A and 6B by way of example. In addition, one reset signal GRES is generated in 1H in FIG. 6A. In FIG. 6B, on the other hand, two reset signals GRES are generated in 1H, to divide 1H into two 0.5H parts. A number (frequency) of grayscale control pulses GCP that corresponds to the maximum number of grayscales that can be supported by the data line driver is generated in each 0.5H.

Note that the rise of the pulse-width modulated signal that is the data line output is regulated by the falling edge of the reset signal GRES in FIGS. 6A and 6B. The fall of the pulse-width modulated signal, on the other hand, is specified by the pulse at a position corresponding to the grayscale data, among pulses within the grayscale control pulses GCP.

Note that various possibilities could be considered for the drive method that can be specified by the display control parameters. For example, the drive could be switched between PWM drive and frame rate control (FRC) drive by a display control parameter. Alternatively, switching of the polarity inversion method (such as frame inversion, line inversion, or dot inversion) could be done by a display control parameter.

Various items could be considered as the grayscale control parameters (GCPSET) of FIG. 4.

Figure 7:
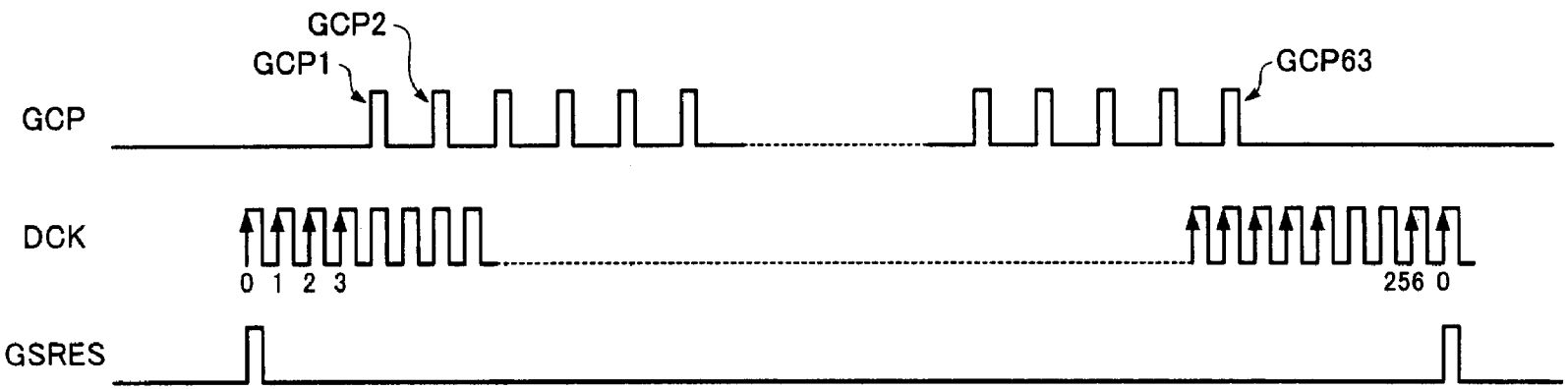
FIG. 7 is illustrative of grayscale control parameters.

For example, as shown in FIG. 7, it is possible to include parameters for setting positions GCP1, GCP2, . . . GCP63 at which the grayscale control pulses goes active, within the grayscale control parameters. It is possible to change the grayscale characteristics to various different characteristics by changing these positions GCP1, GCP2, . . . GCP63.

Note that the drive method of grayscale control in accordance with this embodiment is not limited to PWM drive, and thus it can also be applied to other drive methods such as FRC. In addition, various other parameters (such as frame rate) for controlling FRC drive could also be included.

An example of refresh period information is shown in FIG. 8A.

This refresh period information enables a setting in which refresh processing is not performed. In addition, the refresh period can be set to every 64, 128, 192, or 256 frames, by way of example. If 64 frames is set, by way of example, the refresh processing is done every 64 frames (K frames).

It is possible to perform refresh processing at the optimal refresh period for each type of display panel, by writing the refresh period information shown in FIG. 8A to the control register 30.

An example of manufacture information is shown in FIG. 8B. The production ID is information for specifying details such as the production lot and factory of the display driver (data line driver, etc.) and display panel. The product version is information for specifying the type of display driver and display panel. The product number is information for specifying individual display drivers and display panels.

If a fault should occur in the display driver or display panel, details such as the production lot, factory, product version, and product number thereof can be specified rapidly by writing manufacture information such as that shown in FIG. 8B to the control register 30 (RDID). This is designed to make the work of fault analysis more efficient.

In other words, the control register 30 is accessible by the MPU 130. This means that the control register 30 can be accessed to obtain the manufacture information in a simple manner during fault analysis, using the firmware (program) operating under the MPU 130. This therefore makes the work of fault analysis far more efficient, in comparison with a method that involves peeling off the package of the IC to check the manufacture information.

With this embodiment, the configuration is such that the manufacture information of FIG. 8B is written automatically to control register 30 (RDID) from the EEPROM 134 during initialization or refresh processing. This simplifies the management of this manufacture information.

6. Register Write Circuit

Figure 9:
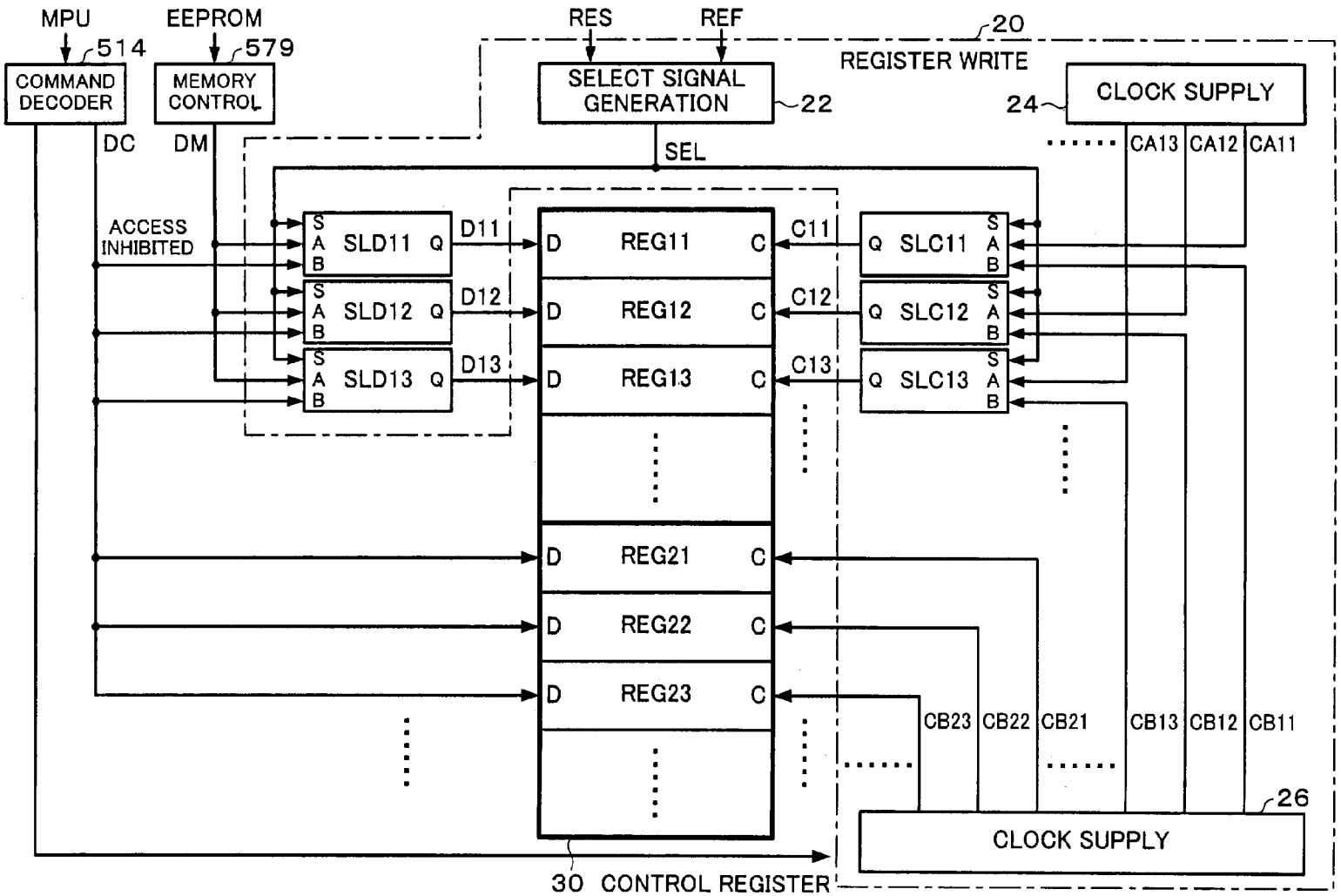
FIG. 9 is a block diagram of a detailed example of the register write circuit.

An example of the configuration of the register write circuit 20 is shown in FIG. 9. This register write circuit 20 includes a select signal generation circuit 22, clock supply circuits 24 and 26, and selectors SLC11, SLC12, SLC13, SLD11, SLD12, and SLD13. Note that some of the circuit blocks of FIG. 9 could be omitted.

In FIG. 9, registers REG11, REG12, REG13, . . . included by the control register 30 are the first register group denoted by E1 in FIG. 4. Similarly, REG21, REG22, REG23, . . . are the second register group denoted by E2 in FIG. 4. Terminal D is a data terminal and terminal C is a clock terminal.

The select signal generation circuit 22 generates the select signal SEL, based on the reset signal RES and the refresh signal REF.

In this case, the reset signal RES and the refresh signal REF are signals that go active at the reset timing and refresh timing, as shown in FIG. 3B. The select signal generation circuit 22 also makes the select signal SEL go active when either of the reset signal RES and the refresh signal REF is active.

A clock supply circuit 24 generates clock signals CA11, CA12, CA13, . . . for writing information from the EEPROM 134 (such as display characteristic control parameters, refresh period information, and manufacture information) to the registers REG11, REG12, REG13, . . . .

Similarly, another clock supply circuit 26 generates CB11, CB12, CB13, . . . , CB21, CB22, CB23, . . . for writing information from the MPU 130 (such as display characteristic control parameters and command parameters) to the registers REG11, REG12, REG13, . . . , REG21, REG22, REG23, . . . .

The selectors SLC11, SLC12, SLC13, . . . each input the select signal SEL from the select signal generation circuit 22 to the select terminal S thereof. The clock signals CA11, CA12, CA13, . . . from the clock supply circuit 24 are input to first input terminals A thereof. Similarly, the clock signals CB11, CB12, CB13, . . . from the clock supply circuit 26 are input to second input terminals B thereof.

When the select signal SEL becomes active, each of the selectors SLC11, SLC12, SLC13, . . . selects the first input terminal A side thereof. The clock signals CA11, CA12, CA13, . . . are output as clock signals C11, C12, C13, . . . to the clock terminals C of the registers REG11, REG12, REG13, . . . .

When the select signal SEL becomes inactive, on the other hand, the selectors SLC11, SLC12, SLC13, . . . each select the second input terminal B side thereof. The clock signals CB11, CB12, CB13, . . . are output as the clock signals C11, C12, C13, to the clock terminals C of the registers REG11, REG12, REG13, . . . .

Note that the only inputs to the registers REG21, REG22, REG23, . . . are the clock signals CB21, CB22, CB23, . . . from the clock supply circuit 26.

The selectors SLD11, SLD12, SLD13, . . . each input the select signal SEL from the select signal generation circuit 22 to the select terminal S thereof. A data (serial data) signal DM from the memory control circuit 579 is input to the first input terminals A thereof. Similarly, a data (serial data) signal from the command decoder 514 is input to the second input terminals B thereof.

When the select signal SEL goes active, each of the selectors SLD11, SLD12, SLD13, . . . selects the first input terminal A side thereof. The data DM is output as data D11, D12, D13, . . . to the data terminals D of the registers REG11, REG12, REG13, . . . .

When the select signal SEL becomes inactive, on the other hand, the selectors SLD11, SLD12, SLD13, . . . each select the second input terminal B side thereof. Data DC is as output data D11, D12, D13, . . . to the data terminals D of the registers REG11, REG12, REG13, . . . .

The configuration shown in FIG. 9 makes it possible for the MPU 130 to access the registers REG11, REG12, REG13, . . . , REG21, REG22, REG23, . . . randomly when the select signal SEL is inactive, in normal operation. This makes it possible to write desired information to any register. Note that in this case, the clock supply circuit 26 outputs only the clock signal corresponding to the register to be accessed by the MPU 130 (the command decoder 514), out of the clock signals CB11, CB12, CB13, . . . , CB21, CB22, CB23, . . . , setting the other clock signals to inactive (always low level, by way of example).

At power-on (at a system reset) or at a refresh, on the other hand, the select signal SEL goes active. In that case, information from the EEPROM 134 (the memory control circuit 579) is sequentially written to the registers REG11, REG12, REG13, . . . that from the first register group.

This makes it possible to automatically write display characteristic control parameters to the registers REG11, REG12, REG1, . . . at power-on or at a refresh.

Note that when the select signal SEL becomes active, access to the registers REG11, REG12, REG13, . . . by the MPU 130 (processing section) is inhibited. This access inhibition is implemented by each of the selectors SLC11, SLC12, SLC13, . . . , SLD11, SLD12, SLD13, . . . selecting the first input terminal A thereof.

In this manner, it is possible to prevent a situation in which access from the MPU 130 clashes with access from the EEPROM 134, which would make the contents of the registers REG11, REG12, REG13, . . . unreliable, by inhibiting access by the MPU 130.

7. Contrast Adjustment

Figure 10:
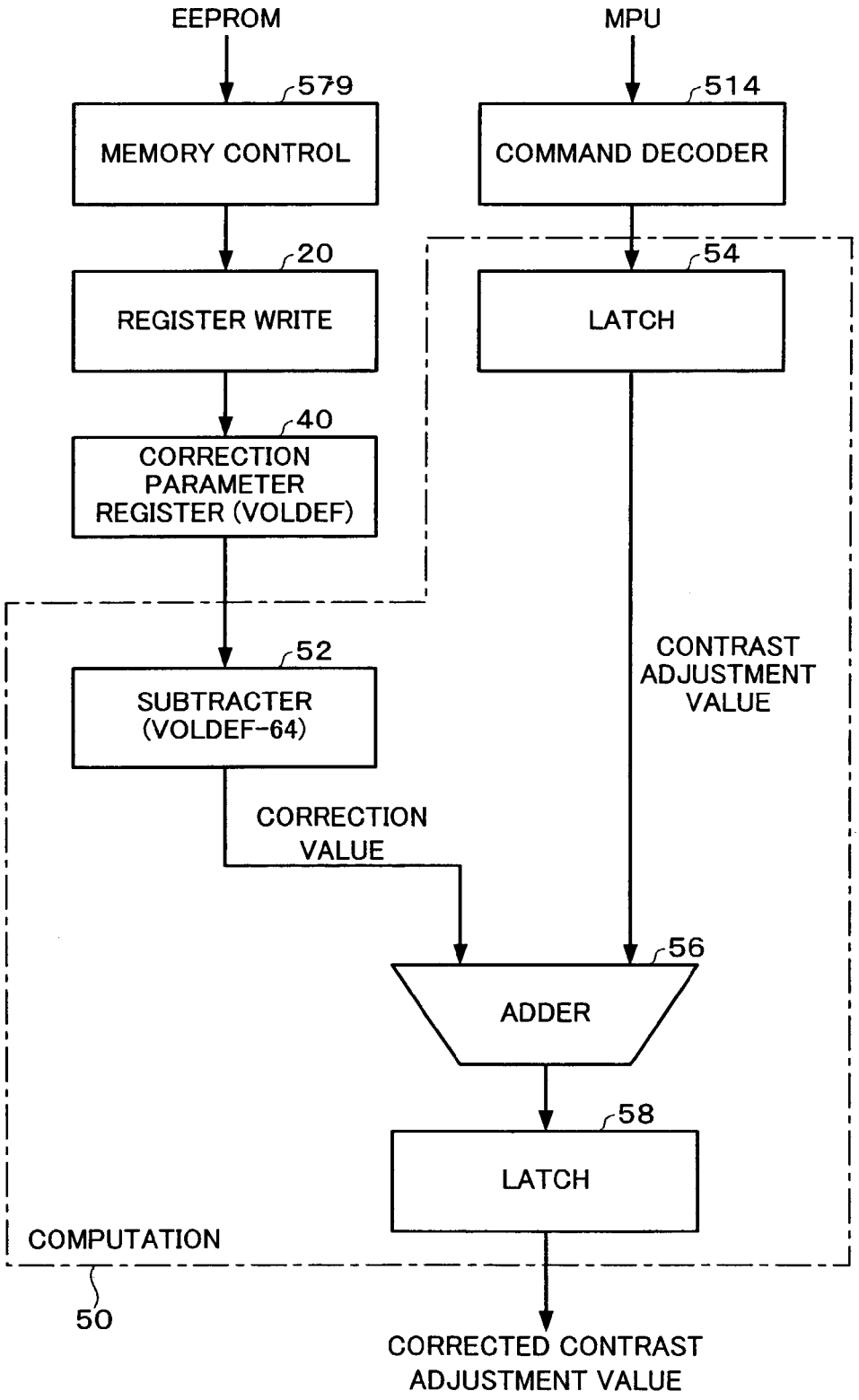
FIG. 10 is a block diagram of a detailed example of the computation circuit.

A detailed example of the computation circuit 50 of FIG. 2 is shown in FIG. 10. This computation circuit 50 includes a subtracter 52, a latch circuit 54, an adder 56, and a latch circuit 58. Note that some of the circuit blocks shown in FIG. 10 could be omitted.

Correction parameters that have been read from the EEPROM 134 are written to the correction parameter register 40 through the memory control circuit 579 and the register write circuit 20. This correction parameter register 40 corresponds to the register VOLDEF of FIG. 4 and it stores a correction parameter that is a contrast adjustment parameter.

The subtracter 52 subtracts 64, which is the contrast reference value, from the value of the correction parameter (VOLDEF) written in the register 40, and outputs the result of the subtraction as the correction value.

The thus-set contrast adjustment value is latched from the MPU 130 into the latch circuit 54 through the command decoder 514. The adder 56 adds the correction value from the subtracter 52 to the contrast adjustment value from the latch circuit 54. The corrected contrast adjustment value that is the result of the addition is latched in the latch circuit 58.

This latched corrected contrast adjustment value is output to the power circuit 132 of FIG. 1 through the power source control circuit 578 of FIG. 2, by way of example. The power circuit 132 generates the power voltage (such as the upper or lower maximum power voltage), based on the thus-corrected contrast adjustment value, for output to other components such as the data line driver 110.

Figure 11:
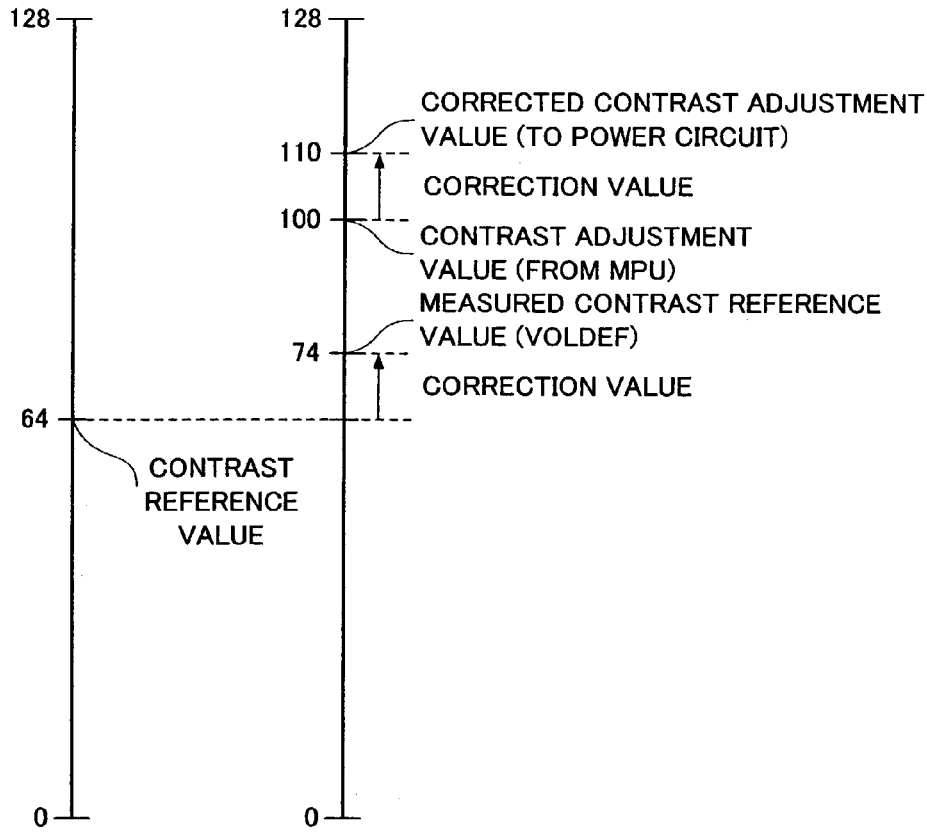
FIG. 11 is illustrative of a method of correcting contrast adjustment values.

Assume that the contrast range (0 to 128) shown in FIG. 11 has been set, by way of example. In this case, the contrast reference value (64) is set as the central value of the contrast range.

During the inspection and at shipping of the liquid-crystal device (electronic instrument), the measured contrast reference value (such as 74) shown in FIG. 11 is measured. When that happens, this measured contrast reference value (measured contrast center value) is written to the EEPROM 134 as a correction parameter.

This measured contrast reference value (74) is written to the register 40 as the correction parameter, through the EEPROM 134 and the register write circuit 20. When that happens, the subtracter 52 subtracts the contrast reference value (64) from the measured contrast reference value (74) that is the correction parameter, to obtain a correction value (10).

Similarly, a contrast adjustment value (for example, 100) from the MPU 130 is latched into the latch circuit 54 through the command decoder 514. When that happens, the adder 56 adds the correction value (10) to this contrast adjustment value (100) to obtain a corrected contrast adjustment value (110).

Figure 12:
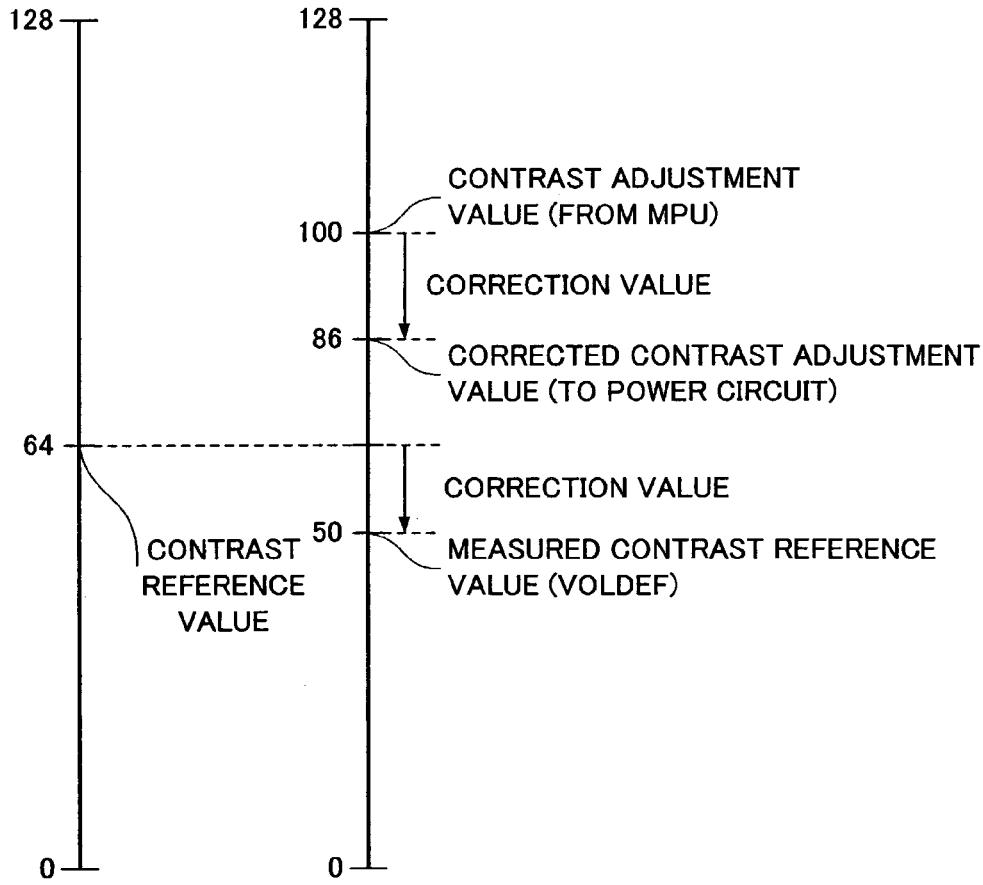
FIG. 12 is illustrative of a method of correcting contrast adjustment values.

FIG. 12 shows an example in which the measured contrast reference value (50) has slipped below the contrast reference value (64). In this case, the subtracter 52 subtracts the contrast reference value (64) from the measured contrast reference value (50) to obtain the correction value (−14). The adder 56 adds the correction value (−14) to the contrast adjustment value (100) to obtain the corrected contrast adjustment value (86).

The method of this embodiment as described above ensures that the firmware operating under the MPU 130 need not be aware of any variation in the measured contrast reference value. In other words, the display panel 100 can be made to display at a contrast corresponding to the contrast reference value (100) that the firmware has set, even if the measured contrast reference value (display characteristic) slips upward as shown in FIG. 11 or downward as shown in FIG. 12.

With this embodiment, the measured contrast reference value (correction parameter) that has been read from the EEPROM 134 is automatically written to the correction parameter register 40 at power-on or at a system reset. There is therefore no need for the firmware operating under the MPU 130 to write this measured contrast reference value to the correction parameter register 40 at power-on or at a system reset. This ensures that it is not necessary to record the measured contrast reference value in firmware. It also makes it possible to use the same firmware for different types of display panel.

With this embodiment, the measured contrast reference value that has been read from the EEPROM 134 is written automatically to the correction parameter register 40 at the given refresh timing. This makes it possible to maintain the contrast characteristics of the display panel 100 at optimal values, even when an external factor such as electrostatic discharge occurs.

Note that a measured contrast reference value is written to the register 40 as the correction parameter in FIG. 10, but it is also possible to write a correction value obtained by subtracting a contrast reference value (64) from the measured contrast reference value to the register 40. In such a case, the subtracter 52 would be unnecessary.

In FIGS. 11 and 12, the contrast reference value is set to substantially the center of the contrast range, but it is equally possible to set the contrast reference value to any other position.

Figure 13:
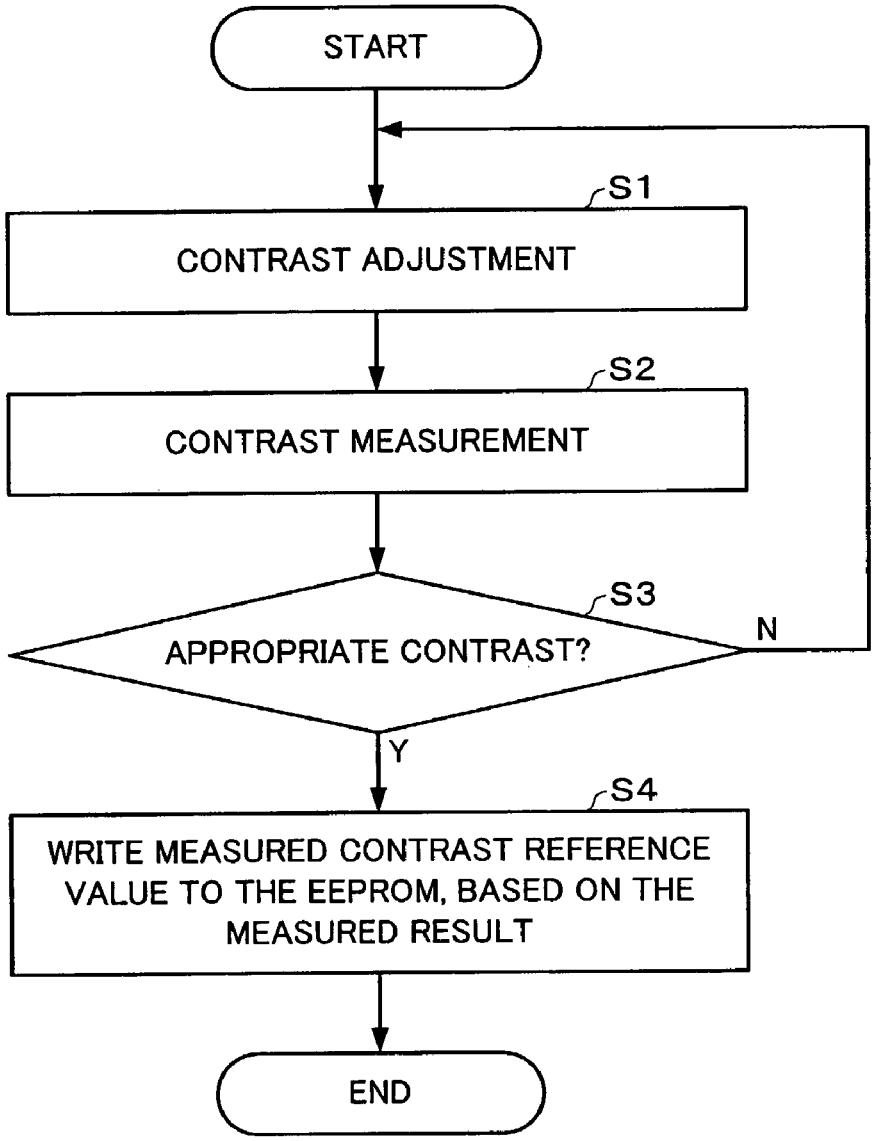
FIG. 13 is a flowchart illustrating the parameter setting process.

A flowchart of the setting of parameters done when the liquid-crystal device is shipped or inspected is shown in FIG. 13.

First of all, the system adjusts the contrast (broadly speaking: the display characteristics) and measures the contrast (steps S1 and S2). More specifically, it sets various contrast adjustment values in the display driver and measures factors such as the brightness of the display panel.

The system then determines whether or not an appropriate contrast has been obtained, based on the measurement results (step S3). If it has not been obtained, the flow returns to step S1 and the contrast adjustment is done again.

If an appropriate contrast has been obtained, on the other hand, a measured contrast reference value (broadly speaking: display characteristic control parameter) is obtained, based on the measurement results at that point, and that measured contrast reference value is written to the EEPROM 134. The inspection of the liquid-crystal device ends.

Note that the present invention is not limited to this embodiment and various modifications could be made thereto within the scope of the present invention.

For example, terminology (such as EEPROM, MPU, liquid-crystal device, data line driver, contrast, and measured contrast reference value) that is quoted as broad terminology (such as memory, processing section, electro-optical device, display driver, display characteristic, and display characteristic control parameter) used within this document could be substituted into broad terminology used elsewhere within this document.

In addition, the configurations of the electro-optical device, display driver (data line driver), register write circuit, control register, and computation circuit described for this embodiment are given by way of example and are not limiting, so various modifications thereto are possible.

Furthermore, the details of the display characteristic control parameters, contrast adjustment parameter, display control parameters, grayscale control parameters, refresh period information, manufacture information, and control register, together with the correction parameters and the like, that are described with reference to this embodiment are merely given as examples and are not limiting, so various modifications thereto are possible.

This embodiment was described as relating to a case in which the present invention is applied to a liquid-crystal device that uses a liquid crystal as an electro-optical material. However, the present invention can also be applied widely to any electro-optical device that uses electro-optical effects such as electro luminescence, a fluorescence display tube, a plasma display, or organic EL.

In addition, the display driver of this embodiment was described as being internal to display data RAM, but it is not limited thereto.

What is claimed is:

1. A display driver for driving a display panel, the display driver comprising:

a control register including a correction parameter register which stores a correction parameter for correcting a contrast adjustment value that is instructed by a processing section;

a computation circuit which adds a correction value specified by the correction parameter to the contrast adjustment value instructed by the processing section, and calculates a corrected contrast adjustment value;

a drive circuit which drives a display panel at a drive voltage that is obtained based on the computed corrected contrast adjustment value;

a memory control circuit which performs access control over a memory which is provided outside or inside the display driver and stores at least the correction parameter; and a register write circuit which writes the correction parameter that has been read from the memory to the correction parameter register at a given refresh timing and performs refresh processing of the correction parameter register, wherein the control register includes a first register group which stores a correction parameter and a second register group, the first register group being related to the refresh processing and being accessible by the processing section, and a second register group not being related to the refresh processing and being accessible by the processing section, wherein the correction parameter is read from the memory through the memory control circuit and is written to the first register group by the register write circuit at a refresh timing, and wherein the information from the processing section is wrote to the first register group in normal operation.

2. The display driver as defined by claim 1, wherein the correction value specified by the correction parameter is a correction value for a contrast reference value that is obtained by measuring a display characteristic of the display panel.

3. The display driver as defined by claim 1, wherein the register write circuit writes the correction parameter to the correction parameter register and performs refresh processing of the correction parameter register, in a non-display period of the display panel.

4. The display driver as defined by claim 1, wherein the register write circuit writes the correction parameter to the correction parameter register periodically and performs refresh processing of the correction parameter register, after power-on or after a system reset.

5. The display driver as defined by claim 1, the register write circuit performing initialization processing of the correction parameter register, at power-on or at a system reset.

6. The display driver as defined by claim 1, wherein the register write circuit inhibits access by the processing section to the correction parameter register while writing the correction parameter to the correction parameter register.

7. The display driver as defined by claim 5, wherein the register write circuit inhibits access by the processing section to the correction parameter register while writing the correction parameter to the correction parameter register.

8. An electro-optical device comprising:

the display driver as defined by claim 1;

the display panel that is driven by the display driver; and the processing section which controls an operation of the display driver.

9. An electro-optical device comprising:

the display driver as defined by claim 5;

the display panel that is driven by the display driver; and the processing section which controls an operation of the display driver.

10. An electro-optical device comprising:

the display driver as defined by claim 6;

the display panel that is driven by the display driver; and the processing section which controls an operation of the display driver.

11. An electro-optical device comprising:

the display driver as defined by claim 7;

the display panel that is driven by the display driver; and the processing section which controls an operation of the display driver.

12. A method of setting a parameter of the display driver as defined by claim 1, comprising:

measuring a display characteristic of the display panel being driven by the display driver; and writing the correction parameter specified by measurement to the memory.

13. A method of setting a parameter of the display driver as defined by claim 5, comprising:

measuring a display characteristic of the display panel being driven by the display driver; and writing the correction parameter specified by measurement to the memory.

14. A method of setting a parameter of the display driver as defined by claim 6, comprising:

measuring a display characteristic of the display panel being driven by the display driver; and writing the correction parameter specified by measurement to the memory.

15. A method of setting a parameter of the display driver as defined by claim 7, comprising:

measuring a display characteristic of the display panel being driven by the display driver; and writing the correction parameter specified by measurement to the memory.

* * * * *